US010041514B2

(12) United States Patent
Takakuwa

(10) Patent No.: US 10,041,514 B2
(45) Date of Patent: Aug. 7, 2018

(54) FLUID PRESSURE CYLINDER

(71) Applicant: SMC KABUSHIKI KAISHA, Chiyoda-ku (JP)

(72) Inventor: Youji Takakuwa, Kitakatsushika-gun (JP)

(73) Assignee: SMC KABUSHIKI KAISHA, Chiyoda-ku (JP)

( * ) Notice: Subject to any disclaimer, the term of this patent is extended or adjusted under 35 U.S.C. 154(b) by 469 days.

(21) Appl. No.: 14/441,900

(22) PCT Filed: Dec. 20, 2012

(86) PCT No.: PCT/JP2012/083031
§ 371 (c)(1),
(2) Date: May 11, 2015

(87) PCT Pub. No.: WO2014/097441
PCT Pub. Date: Jun. 26, 2014

(65) Prior Publication Data

US 2015/0285277 A1 Oct. 8, 2015

(51) Int. Cl.
*F15B 15/14* (2006.01)
*F15B 15/17* (2006.01)
(Continued)

(52) U.S. Cl.
CPC ..... *F15B 15/149* (2013.01); *F15B 15/14* (2013.01); *F15B 15/17* (2013.01); *F15B 11/024* (2013.01); *F15B 11/064* (2013.01)

(58) Field of Classification Search
CPC .. F15B 11/024; F15B 11/064; F15B 15/1447; F15B 15/17; F03C 1/0073
(Continued)

(56) References Cited

U.S. PATENT DOCUMENTS 3,943,972 A * 3/1976 Bitonti ..... F15B 11/064 137/596.17
7,370,569 B2 * 5/2008 Schmidt ..... B30B 15/16 60/486
(Continued)

FOREIGN PATENT DOCUMENTS

CN 2667221 Y 12/2004
DE 2221578 A1 * 11/1973 ..... F15B 11/024
(Continued)

OTHER PUBLICATIONS

Combined Office Action and Search Report dated Jan. 4, 2016 in Chinese Patent Application No. 201280077809.3 with English translation.
(Continued)

*Primary Examiner* — Michael Leslie
*Assistant Examiner* — Matthew Wiblin
(74) *Attorney, Agent, or Firm* — Oblon, McClelland, Maier & Neustadt, L.L.P.

(57) ABSTRACT

In a fluid pressure cylinder, first and second cylinder chambers facing respective opposite end surfaces of a piston are formed inside a cylinder tube including a supply port and a discharge port, and a first piston rod connected to one end surface side of the piston is formed to have a greater diameter than that of a second piston rod connected to another end surface side of the piston. Therefore, a second pressure-receiving area of a second pressure-receiving surface formed on the other end surface of the piston is greater than a first pressure-receiving area of a first pressure-receiving surface formed on the one end surface. Pressure fluid in the first cylinder chamber is supplied to the second cylinder chamber, whereby area difference between the first pressure-receiving area and the second pressure-receiving area causes the piston to move toward the first cylinder chamber.

6 Claims, 4 Drawing Sheets

(51) Int. Cl.
*F15B 11/024* (2006.01)
*F15B 11/064* (2006.01)

(58) Field of Classification Search
USPC ..... 91/416, 417 R
See application file for complete search history.

(56) References Cited

U.S. PATENT DOCUMENTS

| | | | | |
|---|---|---|---|---|
| 2003/0136254 | A1 * | 7/2003 | Hirano | F15B 11/024 91/462 |
| 2003/0145723 | A1 | 8/2003 | Blackman et al. | |

FOREIGN PATENT DOCUMENTS

| | | | | |
|---|---|---|---|---|
| DE | 197 14 144 | A1 | 1/1998 | |
| DE | 102009008367 | A1 * | 8/2010 | F15B 11/024 |
| DE | 102011108304 | A1 * | 1/2013 | F15B 15/1447 |
| JP | 53-8780 | A | 1/1978 | |
| JP | 8-42511 | A | 2/1996 | |
| JP | 10-61609 | A | 3/1998 | |
| JP | 2001-287175 | A | 10/2001 | |

OTHER PUBLICATIONS

International Search Report dated Feb. 26, 2013 in PCT/JP2012/083031 filed Dec. 20, 2012.
Korean Office Action dated Feb. 17, 2017 in Patent Application No. 10-2015-7015679 (with partial English translation).
Office Action dated Aug. 3, 2017 in German Patent Application No. 11 2012 007 092.5.

* cited by examiner

FLUID PRESSURE CYLINDER

TECHNICAL FIELD

The present invention relates to a fluid pressure cylinder for displacing a piston along an axial direction under the supply of a pressure fluid.

BACKGROUND ART

Conventionally, as a transport means for transporting workpieces or the like, a fluid pressure cylinder has been used having a piston that is displaced under the supply of a pressure fluid.

With a fluid pressure cylinder of this type, recently, from the standpoint of energy conservation, a demand has arisen to reduce the amount of pressure fluid that is used. For responding to such a demand, for example, with the fluid pressure cylinder disclosed in Japanese Laid-Open Patent Publication No. 08-042511, a supply unit that supplies the pressure fluid is connected through a switching valve to two cylinder chambers. In the case that a piston is displaced in one direction, under a switching action of the switching valve, the pressure fluid is supplied at a desired pressure to one of the cylinder chambers from a pressure fluid supply source, whereby the piston is displaced. Along therewith, a piston rod is displaced so as to become accommodated in the interior of the cylinder body.

On the other hand, in the case that the piston is displaced in the other direction, under a switching action of the switching valve, the pressure fluid from the one cylinder chamber is supplied to the other cylinder chamber, and the piston is pressed and displaced in the other direction through another end surface of the piston, which has a larger pressure-receiving area than the one end surface of the piston that faces toward the one cylinder chamber. In this manner, normally, the piston is displaced in the other direction using the pressure fluid that is discharged to the exterior, whereby the amount of consumption of the pressure fluid is reduced.

SUMMARY OF THE INVENTION

With the above-described fluid pressure cylinder, at a time of pulling, i.e., when the piston rod is accommodated in the interior of the cylinder body, the piston and the piston rod are moved under the supply of the pressure fluid, and conversely, at a time of pushing when the piston rod is made to project out from the cylinder body, the piston and the piston rod are moved using the pressure fluid that is discharged or ejected from one of the cylinder chambers. However, for example, in the case that a workpiece or the like is transported by the fluid pressure cylinder, by a pushing operation of the piston rod, the workpiece is transported in a direction to separate away from the cylinder tube. In such a situation, since the pressure of the pressure fluid when the piston is displaced toward the pressing side is governed by the discharged pressure fluid, a sufficient thrust force cannot be obtained for pushing the workpiece by the piston rod. For this reason, with the fluid pressure cylinder, although the consumption amount of the pressure fluid can be reduced, problems occur in relation to obtaining a desired thrust force for displacing the workpiece.

A general object of the present invention is to provide a fluid pressure cylinder, which enables energy conservation by reducing the amount of consumed pressure fluid for displacing a piston, while at the same time allowing the piston to be displaced reliably and highly precisely with a desired thrust force.

The present invention is characterized by a fluid pressure cylinder including a cylinder main body including a pair of ports through which a pressure fluid is supplied, and a pair of cylinder chambers to which the pressure fluid is introduced through the ports, a piston disposed displaceably along an axial direction inside the cylinder chambers, and a piston rod assembly including a first rod that is connected to one end side of the piston, and a second rod that is connected to another end side of the piston, the piston rod assembly being supported displaceably in the cylinder main body. The piston is equipped with a first pressure-receiving surface, which is formed on one end surface side of the piston and faces toward one of the cylinder chambers, and a second pressure-receiving surface, which is formed another end surface side of the piston and faces toward another of the cylinder chambers, and the second pressure-receiving surface is greater in area than the first pressure-receiving surface. The piston and the second rod are displaced to one side by supplying a pressure fluid to the one of the cylinder chambers, and the piston and the first rod are displaced to another side by supplying the pressure fluid of the one of the cylinder chambers to the other of the cylinder chambers.

According to the present invention, the piston that constitutes part of the fluid pressure cylinder is equipped with the first pressure-receiving surface, to which a pressure of the pressure fluid is applied and which faces toward one of the cylinder chambers of the cylinder main body, and a second pressure-receiving surface, which faces toward the other of the cylinder chambers and is greater in area than the first pressure-receiving surface. Then, the piston and the second rod are displaced to one side through the first pressure-receiving surface, by supplying a pressure fluid to the one cylinder chamber, whereas the piston and the first rod are displaced to another side by supplying the pressure fluid of the one cylinder chamber to the other cylinder chamber.

Consequently, when the piston is restored to the other side, by pressing the piston through the second pressure-receiving surface which is formed with a large area, the pressure fluid can reliably displace the piston and the first rod to the other side.

As a result, in the case that the piston is displaced to the one side, the piston can be displaced with a desired thrust force by the pressure fluid that is supplied from the pressure fluid supply source, whereas in the case that the piston is restored to the other side, compared to a situation of supplying pressure fluid anew to the other cylinder chamber, the amount of consumed pressure fluid can be reduced, and thus energy savings can be realized.

The above objects, features and advantages of the present invention will be easily understood from the following description of a preferred embodiment when taken in conjunction with the accompanying drawings.

DESCRIPTION OF EMBODIMENTS

Figure 1:
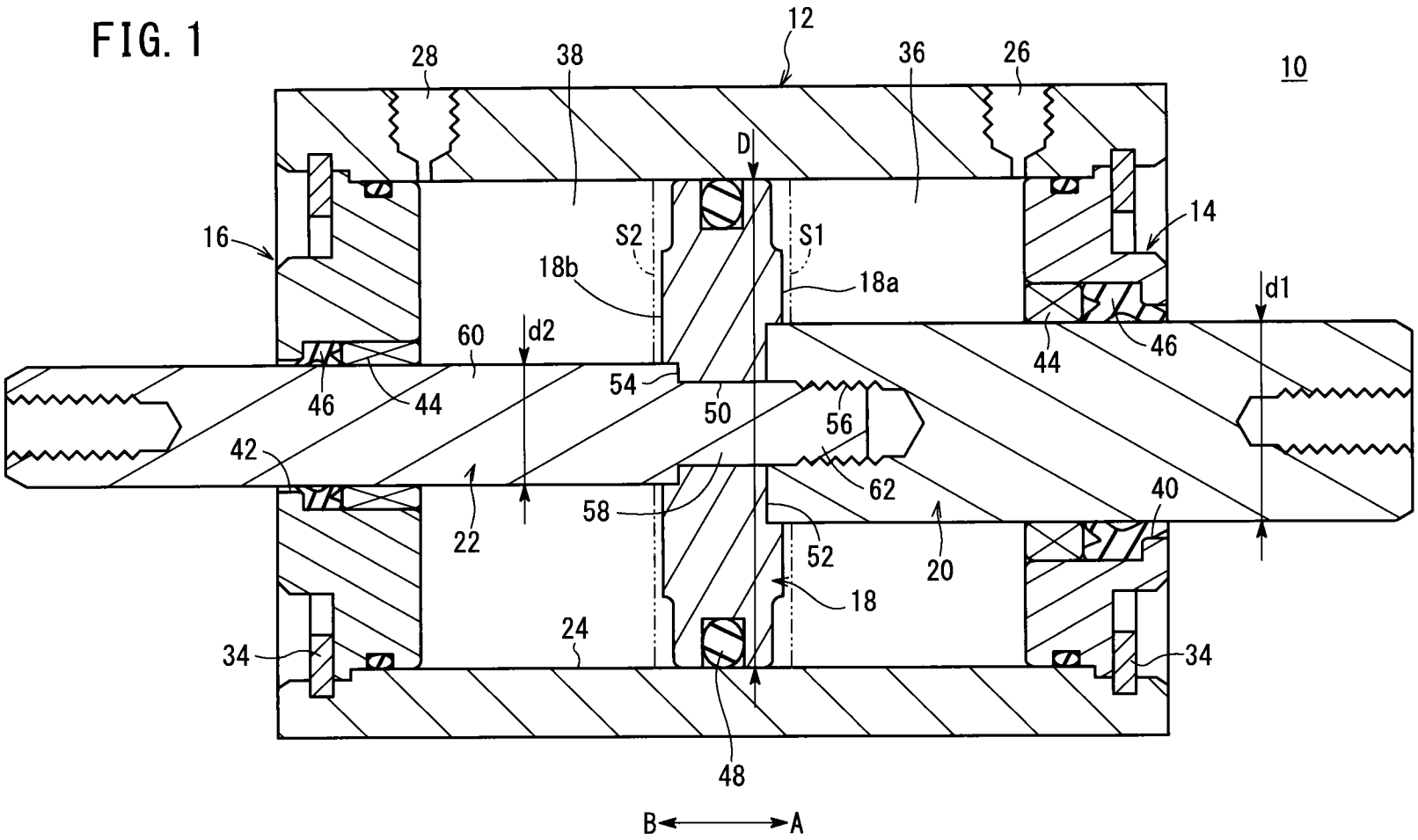
FIG. 1 is an overall cross-sectional view of a fluid pressure cylinder according to an embodiment of the present invention.
Figure 2:
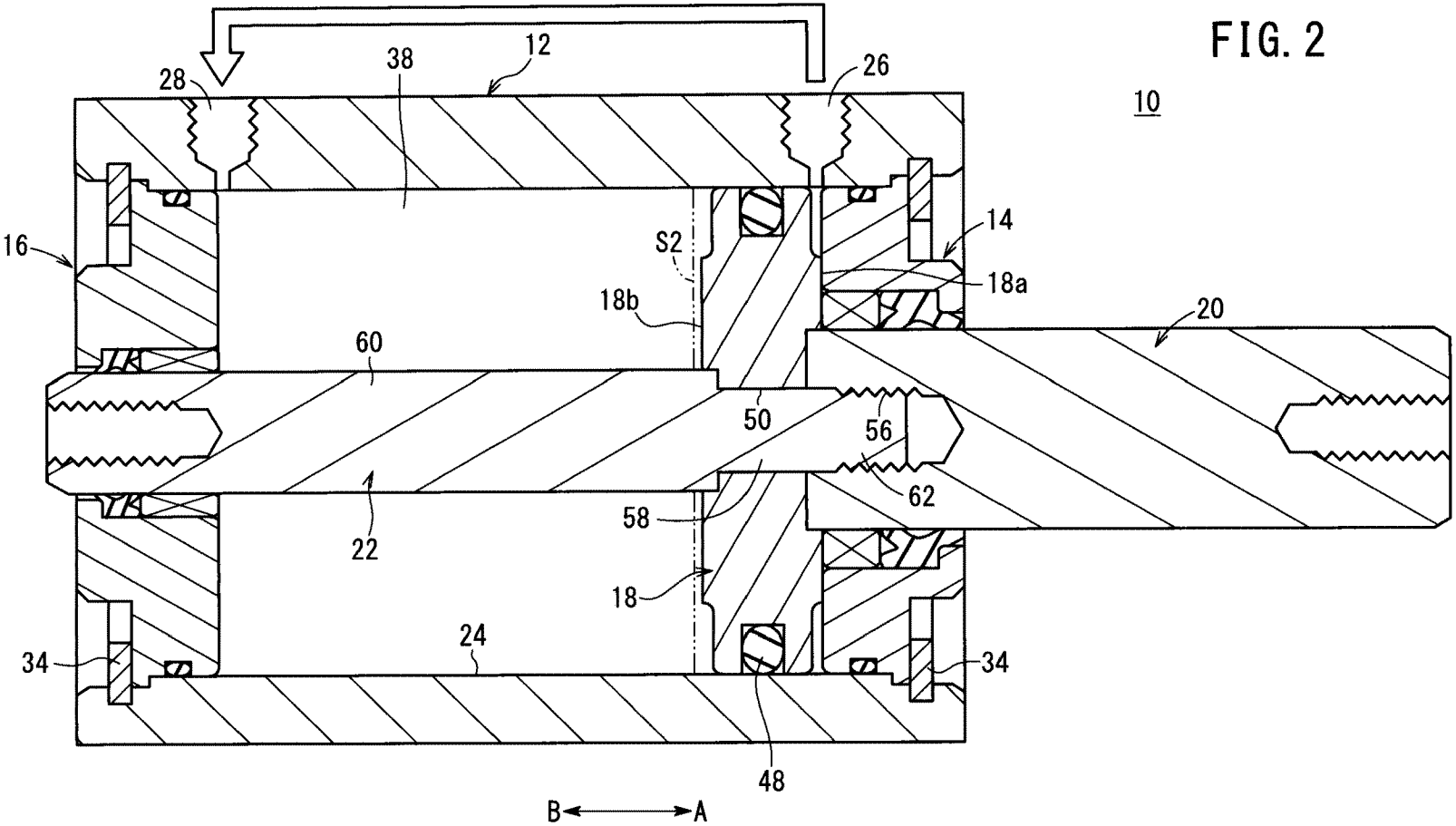
FIG. 2 is an overall cross-sectional view showing a condition in which a piston in the fluid pressure cylinder of FIG. 1 is in an initial position where the piston is displaced toward and brought into abutment against a side of a first end cover.
Figure 3:
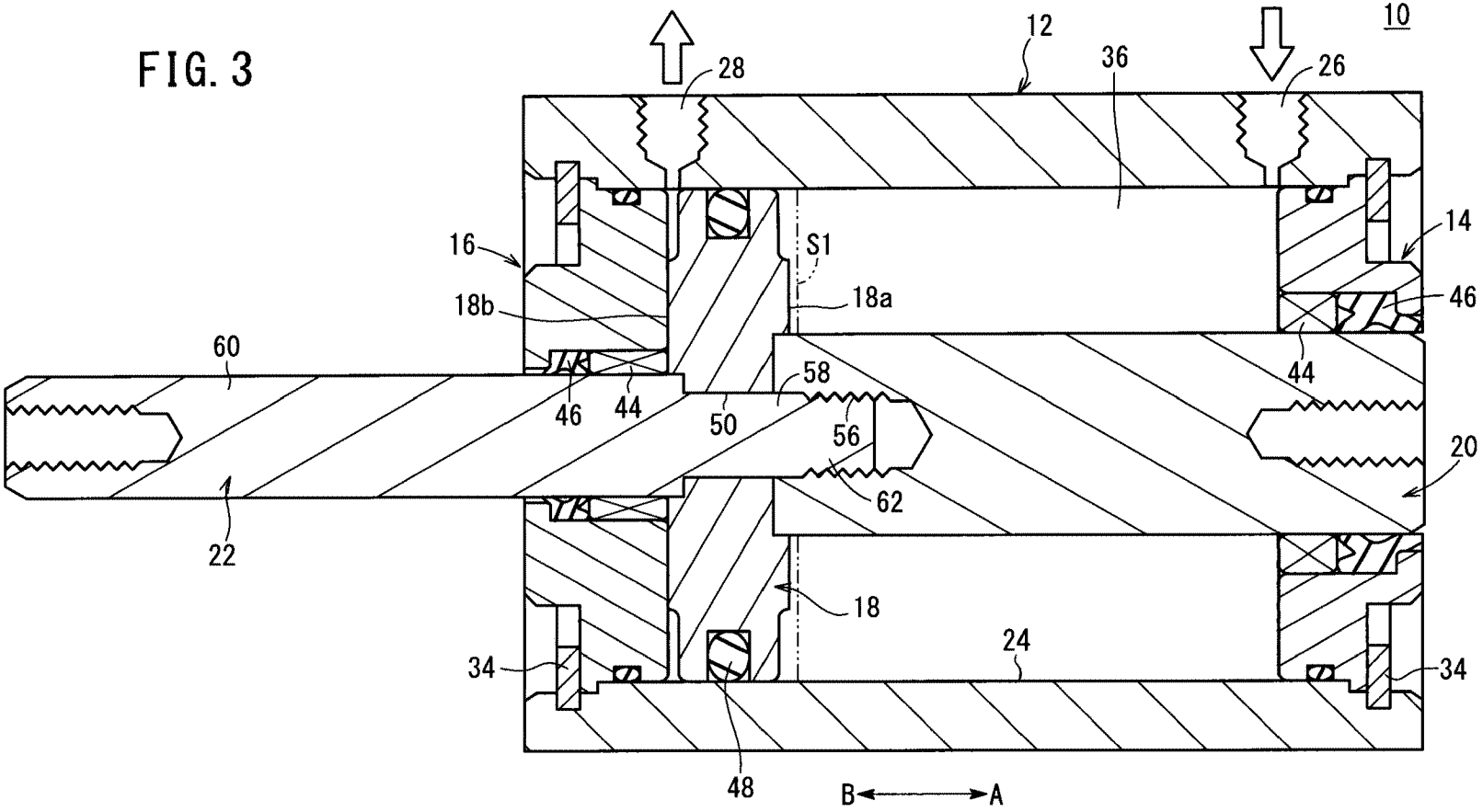
FIG. 3 is an overall cross-sectional view showing a condition in which the piston in the fluid pressure cylinder of FIG. 1 is in an end position where the piston is displaced toward and brought into abutment against a side of a second end cover.

As shown in FIGS. 1 through 3, a fluid pressure cylinder 10 includes a tubular cylinder tube 12, first and second end covers 14, 16 that are mounted on opposite ends of the cylinder tube 12, a piston 18 that is disposed for displacement in the interior of the cylinder tube 12, and first and second piston rods 20, 22 that are connected to center portions of the piston 18. The fluid pressure cylinder 10 is a double rod type of fluid pressure cylinder, wherein the first and second piston rods 20, 22 are connected to respective opposite end surfaces of the piston 18.

The cylinder tube 12 is formed with a substantially rectangular shape in cross section, for example. In the interior of the cylinder tube 12, a cylinder hole 24, which is cylindrical in cross section, penetrates along the axial direction (the direction indicated by arrows A and B). The cylinder hole 24 is formed with the same cross-sectional shape along the axial direction of the cylinder tube 12.

Figure 4:
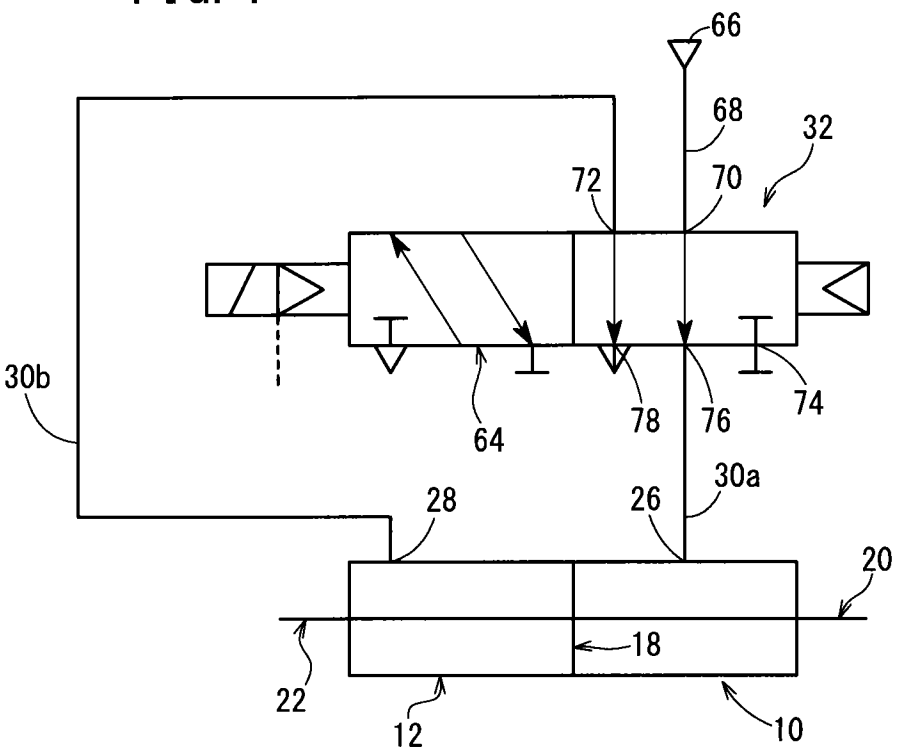
FIG. 4 is a circuit diagram including the fluid pressure cylinder of FIG. 1, and a switching mechanism that switches a supply condition of a pressure fluid with respect to the fluid pressure cylinder.

Further, on the outer peripheral side of the cylinder tube 12, a supply port 26 and a discharge port 28 open respectively at positions in the vicinity of one end and another end of the cylinder tube 12. In addition, as shown in FIG. 4, pipes 30*a*, 30*b* are connected respectively to the supply port 26 and the discharge port 28, and a switching mechanism 32 (to be described later), which switches a supply state of the pressure fluid, is connected through the pipes 30*a*, 30*b* to the supply port 26 and the discharge port 28.

The first and second end covers 14, 16 are mounted in the interior of the cylinder hole 24, respectively, at one end and another end of the cylinder tube 12. Regions thereof, which are expanded radially outward, are engaged respectively with stepped parts of the cylinder hole 24, and thereafter, locking rings 34 are fitted in engagement with an inner circumferential surface of the cylinder hole 24 to thereby fix the first and second end covers 14, 16 respectively in the cylinder hole 24. In addition, in the cylinder tube 12, a first cylinder chamber 36 that communicates with the supply port 26 is formed between the first end cover 14 and the piston 18, and a second cylinder chamber 38 that communicates with the discharge port 28 is formed between the second end cover 16 and the piston 18.

Further, first and second rod holes 40, 42 are formed respectively in center portions of the first and second end covers 14, 16 so as to penetrate along the axial direction. Bushes 44 and rod packings 46 are mounted respectively on inner circumferential surfaces of the first and second rod holes 40, 42. The first and second piston rods 20, 22 are inserted respectively through the first and second rod holes 40, 42, and are supported respectively by the bushes 44 for displacement along the axial direction. In addition, by being placed in sliding contact with the rod packings 46, leakage of pressure fluid is prevented from occurring, respectively, between the first and second piston rods 20, 22 and the first and second end covers 14, 16.

The piston 18, for example, is formed in the shape of a disk having a predetermined thickness, and a piston packing 48 is installed through an annular groove on an outer circumferential surface thereof. In addition, by the piston packing 48 being placed in sliding contact with the inner circumferential surface of the cylinder hole 24, leakage of pressure fluid from between the piston 18 and the cylinder tube 12 is prevented.

Further, a through hole 50 that penetrates in the axial direction (the direction of arrows A and B) is formed in the center of the piston 18. A later-described small diameter portion 58 of the second piston rod 22 is inserted through the through hole 50. In addition, a first stepped part 52, with which the first piston rod 20 is engaged, is recessed in one end surface of the piston 18 that faces toward the first end cover 14 (in the direction of the arrow A). The first stepped part 52 is expanded in diameter with respect to the through hole 50.

On the other hand, on the other end surface of the piston 18 that faces toward the second end cover 16 (in the direction of the arrow B), a second stepped part 54 is formed, which is expanded in diameter with respect to the through hole 50 and is recessed at a predetermined depth. The second piston rod 22 is engaged with the second stepped part 54.

The first and second piston rods 20, 22, respectively, are made up from straight shafts, which are mutually connected on the same axis sandwiching the piston 18 therebetween. The first piston rod (first rod) 20 is disposed on the side of the first end cover 14 (in the direction of the arrow A), and the second piston rod (second rod) 22 is disposed on the side of the second end cover 16 (in the direction of the arrow B).

The first piston rod 20 is formed with substantially the same diameter along the axial direction, and is supported displaceably by one end thereof being inserted through the first rod hole 40 of the first end cover 14, whereas on the other end thereof, a threaded hole 56 opens, with which a threaded portion 62 of the second piston rod 22 is screw engaged, and the other end is inserted into and engages with the first stepped part 52 of the piston 18.

The second piston rod 22 is made up from a small diameter portion 58 formed on one end thereof, which is inserted through the through hole 50 of the piston 18, and a large diameter portion 60 formed on the other end thereof, which is greater in diameter than the small diameter portion 58. The small diameter portion 58 includes the threaded portion 62 with threads engraved on the outer circumferential surface in the vicinity of a distal end of the small diameter portion 58. In addition, by the threaded portion 62 being screw-engaged in a threaded hole 56 of the first piston rod 20 in a state of being inserted through the through hole 50 of the piston 18, the first piston rod 20 and the second piston rod 22 are connected together sandwiching the piston 18 mutually therebetween. At this time, since the first and second piston rods 20, 22 engage with the piston 18 through the first and second stepped parts 52, 54, the first and second piston rods 20, 22 and the piston 18 are connected together integrally and are maintained in a mutually coaxial condition.

Further, the large diameter portion 60 of the second piston rod 22 is supported displaceably along the axial direction, by one end thereof being engaged with the second stepped part 54 of the piston 18, and the other end thereof being inserted through the second rod hole 42 of the second end cover 16.

Furthermore, the diameter d1 of the first piston rod 20 is greater than the diameter d2 of the large diameter portion 60 on the second piston rod 22 (d1>d2). In addition, a first pressure-receiving surface 18*a* is formed on one end surface of the piston 18 facing the first cylinder chamber 36, and a second pressure-receiving surface 18*b* is formed on another end surface of the piston 18 facing the second cylinder chamber 38. The second pressure-receiving area S2 of the second pressure-receiving surface 18*b* is greater than the first pressure-receiving area S1 of the first pressure-receiving surface 18*a* (S2>S1).

More specifically, the diameter d1 of the first piston rod 20 is greater than the diameter d2 of the large diameter portion 60 on the second piston rod 22, and accordingly, based on differences with respect to the diameter D of the piston 18, the first and second pressure-receiving areas S1, S2 are such that the second pressure-receiving area S2 is greater than the first pressure-receiving area S1 (D–d1<D–d2).

Next, with reference to FIG. 4, a description will be given concerning the switching mechanism 32 that is connected to the supply port 26 and the discharge port 28 of the fluid pressure cylinder 10.

The switching mechanism 32, for example, is made up from a 5-port solenoid valve 64, which is capable of switching the supply state of a pressure fluid to the supply port 26 and the discharge port 28 of the fluid pressure cylinder 10 based on control signals from a non-illustrated controller, and includes a first port 70 that is connected through a supply pipe 68 to a pressure fluid supply source 66, a second port 72 that is connected to the discharge port 28 of the cylinder tube 12, a third port 74 that is blocked from communication with the exterior, a fourth port 76 that is connected through the pipe 30*a* to the supply port 26 of the cylinder tube 12, and a fifth port 78 that communicates with the exterior in a state of being open to atmosphere. In addition, in an OFF state in which a control signal is not being output to the switching mechanism 32, by a connection between the first port 70 and the fourth port 76, the pressure fluid from the pressure fluid supply source 66 is supplied to the supply port 26, and by a connection between the second port 72 and the fifth port 78, the discharge port 28 is in a state of being open to atmosphere in communication with the exterior.

On the other hand, in a condition of the switching mechanism 32 being switched to an ON state by a control signal from a non-illustrated controller, by a connection between the first port 70 and the third port 74, supply of pressure fluid to the fluid pressure cylinder 10 from the pressure fluid supply source 66 is blocked, and by a connection between the second port 72 and the fourth port 76, the supply port 26 and the discharge port 28 are placed in a state of communication. The switching mechanism 32, for example, is mounted on an upper surface of the cylinder tube 12 where the supply port 26 and the discharge port 28 are open.

The fluid pressure cylinder 10 according to the embodiment of the present invention is constructed basically as described above. Next, operations and advantages of the fluid pressure cylinder 10 will be described. In this regard, an initial condition is defined by a state in which, under a switching action of the switching mechanism 32, the pressure fluid of the first cylinder chamber 36 is supplied to the second cylinder chamber 38, so that as shown in FIG. 2, the piston 18 is displaced toward the first end cover 14 (in the direction of the arrow A) and abuts against the first end cover 14, and the second piston rod 22 is accommodated in the interior of the cylinder tube 12.

In the initial condition, by input of a control signal to the switching mechanism 32 from the non-illustrated controller, the switching mechanism 32 is switched, so that by connection between the first port 70 and the fourth port 76, the pressure fluid supply source 66 communicates with the supply port 26, whereas the second port 72 is connected with the fifth port 78 and is placed in a state of being open to atmosphere in communication with the exterior. Consequently, pressure fluid is supplied from the supply port 26 to the first cylinder chamber 36, and the piston 18 is pressed and displaced toward the second end cover 16 (in the direction of the arrow B), accompanied by the first and second piston rods 20, 22 being displaced together integrally. On the other hand, the pressure fluid that remains in the second cylinder chamber 38 passes through the discharge port 28, the pipe 30*b*, and the second port 72, and is then discharged to the exterior from the fifth port 78.

As a result, the second piston rod 22 is displaced to project gradually outward with respect to the second end cover 16, whereas the first piston rod 20 is displaced gradually through the first end cover 14 so as to become accommodated in the interior of the cylinder tube 12. In addition, as shown in FIG. 3, the other end surface of the piston 18 is brought into abutment against the second end cover 16 so that the end position is reached, and a workpiece is transported to a predetermined position, for example, by a transport device that is connected to the end of the second piston rod 22. Stated otherwise, by displacement from the initial position to the end position of the fluid pressure cylinder 10, the non-illustrated workpiece can be pressed outwardly, by the pressing force of the second piston rod 22, in a direction (the direction of the arrow B) to separate away from the fluid pressure cylinder 10, whereby the workpiece can be transported.

Further, in the case that the first piston rod 20 is utilized, by displacement from the initial position to the end position of the fluid pressure cylinder 10, the non-illustrated workpiece can be pulled, by a pulling force of the first piston rod 20, toward the fluid pressure cylinder 10 (in the direction of the arrow B), whereby the workpiece can be transported.

Next, in the case that the piston 18 is displaced to the side of the first end cover 14 (in the direction of the arrow A) and is restored to the initial position, by stopping output of the control signal to the switching mechanism 32 from the non-illustrated controller, the switching mechanism 32 is switched, so that the first port 70 and the third port 74 are connected to each other, and supply of the pressure fluid from the pressure fluid supply source 66 is blocked by the switching mechanism 32, together with the second port 72 and the fourth port 76 being connected and placed in communication with each other. Consequently, the pressure fluid in the first cylinder chamber 36 passes through the supply port 26, the pipe 30*a* and the switching mechanism 32, and is supplied from the discharge port 28 into the second cylinder chamber 38. In this case, the pressure fluid remaining in the first cylinder chamber 36 attains the same pressure as the pressure fluid that is supplied to the second cylinder chamber 38.

In addition, in the first and second cylinder chambers 36, 38, since the pressure-receiving areas of the piston 18, which are pressed by the pressure fluid, are such that the second pressure-receiving area S2 of the second pressure-receiving surface 18*b* on the side of the second cylinder chamber 38 is set to be greater than the first pressure-receiving area S1 of the first pressure-receiving surface 18*a* on the side of the first cylinder chamber 36, the pressing force that presses the piston 18 toward the first end cover 14 (in the direction of the arrow A) overcomes the pressing force toward the second end cover 16, and as a result, the piston 18 and the second piston rod 22 are displaced toward the first end cover 14 (in the direction of the arrow A). The one end surface of the piston 18 also comes into abutment against the first end cover 14, and thus is restored to the initial position (see FIG. 2).

In this case, since the pressing force applied to the piston 18 is generated by the pressure fluid that is discharged into the second cylinder chamber 38 from the first cylinder chamber 36, the pressing force applied to the piston 18 is smaller in comparison with the pressing force applied when the piston 18 is moved to the end position. For this reason, with the fluid pressure cylinder 10, a workpiece is transported by a pressing force (or a pulling force) that is applied when the piston 18 is displaced from the initial position to the end position, whereas, in a case that the piston 18 is restored from the end position to the initial position, displacement of the piston 18 alone is carried out using the discharged pressure fluid without transporting the workpiece.

In the foregoing manner, with the present embodiment, in the fluid pressure cylinder 10 in which the piston 18 is displaced under the supply of a pressure fluid, the first pressure-receiving area S1 of the first pressure-receiving surface 18*a* on the side of the first cylinder chamber 36 to which the pressure fluid is supplied when the piston 18 is displaced to the end position is smaller than the second pressure-receiving area S2 of the second pressure-receiving surface 18*b* on the side of the second cylinder chamber 38 to which the pressure fluid is supplied when the piston 18 is restored to the initial position (S1<S2). As a result, when the piston 18 is displaced from the initial position to the end position by the pressure fluid that is supplied to the first cylinder chamber 36, the piston 18 is pressed at a desired pressing force toward the second end cover 16 (in the direction of the arrow B), whereupon a non-illustrated workpiece can be transported in a direction (the direction of the arrow B) to separate away from the second end cover 16 at a predetermined pressing force by the second piston rod 22. On the other hand, when the piston 18 is restored to the initial position from the end position, under a switching action of the switching mechanism 32, the pressure fluid that was supplied to the first cylinder chamber 36 is supplied (discharged) into the second cylinder chamber 38, whereby the piston 18 can be pressed and displaced in order to be restored to the initial position, due to the difference in area (S2−S1) between the first pressure-receiving area S1 and the second pressure-receiving area S2.

In this manner, when the piston 18 is restored to the initial position, the pressure fluid supplied to the first cylinder chamber 36 is not discharged to the exterior, but can be supplied to the second cylinder chamber 38 and used for the purpose of displacing the piston 18. As a result, when the piston 18 is displaced to the initial position from the end position, compared to a situation in which pressure fluid is supplied anew to the second cylinder chamber 38, the amount of consumed pressure fluid can be reduced, and thus energy savings can be realized.

Stated otherwise, by setting the first pressure-receiving area S1 of the first pressure-receiving surface 18*a* and the second pressure-receiving area S2 of the second pressure-receiving surface 18*b* to have different areas (S1<S2), in the case that pressure fluid is supplied simultaneously to the first and second cylinder chambers 36, 38, a difference in the pressing forces that press on the piston 18 can be provided, and due to this difference, the piston 18 can be displaced toward the initial position (in the direction of the arrow A).

Further, since the fluid pressure cylinder 10 is of a double rod type having the first piston rod 20 and the second piston rod 22 that are connected respectively to one end surface and another end surface of the piston 18, for example, in the case it is desired for a non-illustrated workpiece to be transported by being pressed in a direction (the direction of the arrow B) to separate away from the fluid pressure cylinder 10, by pressing the workpiece by way of the second piston rod 22, which is displaced in the pressing direction by the pressure fluid from the pressure fluid supply source 66, the workpiece can be transported reliably and with high precision at a desired pressing force (thrust force).

On the other hand, in the case that the workpiece is to be transported by being pulled in a direction (the direction of the arrow B) toward the fluid pressure cylinder 10, by pulling the workpiece by way of the first piston rod 20, which is displaced in the pulling direction by the pressure fluid from the pressure fluid supply source 66, the workpiece can be transported reliably and with high precision at a desired pulling force (thrust force).

More specifically, either one of the pair of first and second piston rods 20, 22 is appropriately selected in response to the transport direction of the workpiece, whereby workpieces can be transported reliably and with high precision without the need for preparing multiple fluid pressure cylinders.

Furthermore, when the piston 18 is restored to the initial position from the end position, the pressing force only requires a size enough to press and displace the piston 18 to the initial position, and such a pressing force may be smaller compared with the pressing force required in the case of displacing the piston 18 to the end position for the purpose of transporting the workpiece. Therefore, the piston 18 can be displaced adequately to the initial position by the pressure of the pressure fluid that is supplied (discharged) into the second cylinder chamber 38 from the first cylinder chamber 36.

Further still, using the first and second piston rods 20, 22 of different diameters, the difference in area (S2−S1) between the first pressure-receiving area S1 and the second pressure-receiving area S2 can be set. Therefore, by modifying the diameters of the first and second piston rods 20, 22, it is possible to freely set the displacement velocity (thrust force) when the piston 18 is displaced from the initial position to the end position, as well as the displacement velocity (thrust force) when the piston 18 is displaced from the end position to the initial position. More specifically, by replacing the first piston rod 20 and the second piston rod 22 with other ones, which are of different diameters, the displacement velocity (thrust force) of the piston 18 can be set freely.

The fluid pressure cylinder according to the present invention is not limited to the above embodiment. Various changes and modifications may be made to the embodiment without departing from the scope of the invention as set forth in the appended claims.

The invention claimed is:

1. A fluid pressure cylinder comprising:

a cylinder main body including a first end cover and a second end cover and including a pair of ports through which a pressure fluid is supplied, and first and second cylinder chambers to which the pressure fluid is introduced through the ports;

a piston disposed displaceably along an axial direction inside the first and second cylinder chambers;

a piston rod assembly including a first rod that is connected to one end surface side of the piston, and a second rod that is connected to another end surface side of the piston, the piston rod assembly being supported displaceably in the cylinder main body; and a switching mechanism connected to the first and second ports and configured to switch between a first state and a second state;

wherein the piston is equipped with a first pressure-receiving surface, which is formed on the one end surface side of the piston and faces toward the first chamber, and a second pressure-receiving surface, which is formed on the other end surface side of the piston and faces toward the second chamber, the second pressure-receiving surface being greater in area than the first pressure-receiving surface, the piston being displaced toward the second end cover by supplying the pressure fluid to the first cylinder chamber, and the piston being displaced toward the first end cover by supplying the pressure fluid of the first cylinder chamber to the second cylinder chamber, and wherein the switching mechanism in the first state blocks fluid communication between a pressure fluid supply source and the first and second cylinder chambers, and establishes fluid communication between the first and second cylinder chambers.

2. The fluid pressure cylinder according to claim 1, wherein a diameter of the first rod is greater than a diameter of the second rod.

3. The fluid pressure cylinder according to claim 1, wherein the switching mechanism is a switching valve having five ports.

4. The fluid pressure cylinder according to claim 1, wherein the switching mechanism in the first state establishes fluid communication from the first cylinder chamber to the second cylinder chamber.

5. The fluid pressure cylinder according to claim 1, wherein the switching mechanism in the second state establishes fluid communication from the pressure fluid supply source to the first cylinder chamber.

6. The fluid pressure cylinder according to claim 5, wherein the switching mechanism in the second state establishes fluid communication from the second cylinder chamber to atmosphere.

* * * * *